US005596849A

United States Patent [19]

Hill

[11] Patent Number: 5,596,849

[45] **Date of Patent: *Jan. 28, 1997**

[54] SHUTTER SYSTEM AND METHOD

[76] Inventor: George A. Hill, 8561 N.W. 52nd St., Lauderhill, Fla. 33351

[ * ] Notice: The term of this patent shall not extend beyond the expiration date of Pat. No. 5,487,244.

[21] Appl. No.: 541,393

[22] Filed: Oct. 10, 1995

Related U.S. Application Data

[63] Continuation-in-part of Ser. No. 344,222, Nov. 23, 1994, Pat. No. 5,487,244.

[51] Int. Cl.[6] ..... E06B 3/26

[52] U.S. Cl. ..... 52/202; 52/783.12; 52/748.1; 49/57; 49/61

[58] Field of Search ..... 52/202, 783.11, 52/783.12, 783.14, 783.15, 784.1, 579, 746.1, 748.1; 49/57, 61, 62, 464

[56] References Cited

U.S. PATENT DOCUMENTS

| | | | |
|---|---|---|---|
| 4,333,271 | 6/1982 | De Paolo et al. | 49/464 |
| 5,345,716 | 9/1994 | Caplan | 49/61 |
| 5,426,893 | 6/1995 | Hoffman | 52/202 X |

*Primary Examiner*—Creighton Smith
*Attorney, Agent, or Firm*—Dominik & Stein

[57] ABSTRACT

A shutter system and method in which the shutters are normally rolled to a nominal one foot width and have an infinite length, normally no less than two feet and no more than twelve feet is disclosed. These dimensions can be modified on one foot modules. The shutters are provided with a self-secured panel lock assembly at the overlapping joints on the inside between the shutter and windows normally on two foot spacing vertically. This can be horizontal, however, in other applications. The system includes the utilization of an angle frame at the base, and an overlapping receiver as a header. End caps may be of varying shapes but normally are typical L-shaped angles. An alternative system is direct mounted and omits the header and the footer, but must extend above and below the opening by a minimum of four inches for a twelve inch wide shutter panel, or two inches for a six inch wide shutter panel. The panel lock assembly and its spacing remains the same as the embodiment utilizing a header and a footer except that the screws are positioned at the top and the bottom of the opening being covered. The shutters are installed by raising the same upwardly and inwardly to the overhang on the upper header, lowering the same to the point where the lower portion overlap has a keyhole slot, aligning the same, and then manually threading the panel lock assembly in place and the bottom lock screw in place. Where the extrusions of the system are not employed, the threaded members engage a concrete anchor secured in the wall of the structure.

6 Claims, 4 Drawing Sheets

SHUTTER SYSTEM AND METHOD

CROSS-REFERENCE TO RELATED APPLICATION

The present application is a continuation-in-part application of Ser. No. 08/344,222 filed Nov. 23, 1994, by the same inventor herein entitled "Shutter System and Method", now U.S. Pat. No. 5,487,244.

BACKGROUND OF THE INVENTION

The present invention relates to shutters of the hurricane variety which are removably secured normally to a dwelling when a hurricane or other strong wind is anticipated. It also has utility in "boarding up" of a house which may be empty for a significant period of time.

SUMMARY OF THE PRIOR ART

A wide variety of shutters such as hurricane shutters have been used starting from the most simplistic five-eighths inch plywood which is screwed or nailed to the wall of a building to overlie a window, to roll up and roll down shutters. The former are inexpensive but not durable and reliable, and the latter are expensive and in some instances relatively unsightly.

After Hurricane Andrew in Dade County, Florida and elsewhere in the country, the requirements for shock testing, impact loading, static loading, and installation have become significantly more strict.

The installation of shutters normally utilizing a strap across the rear portion with nuts going through the front of the corrugated panels, can be cumbersome and difficult to achieve the appropriate spaced relationship.

Illustrative of the prior art are U.S. Pat. Nos. 2,568,195 to Jones which discloses overlapping storm shutters, female anchors in concrete, and brackets permanently affixed to the building. U.S. Pat. No. 2,719,750 to Orr discloses a keyhole slot in a panel for attachment to an automobile; U.S. Pat. No. 2,867,011 to Becjer discloses a shutter structure using a fastener comprising a thumb screw and wing nut for attaching storm shutters together; and U.S. Pat. No. 2,878,536 discloses corrugated overlapping shutters having brackets affixed to the building. None of the subject patents discloses an entire shutter system to generate a strong monocoque shield which can be quickly installed and dismounted by a single person using no tools.

What is needed is a system including panels and the joint structure which can be readily installed by the home owner without the use of any special tools. Despite that simplistic approach, it must have significant strength characteristics.

SUMMARY OF THE INVENTION

The present invention is directed to a shutter system and method in which the shutters are normally rolled to a nominal one foot width and have an infinite length, normally no less than two feet and no more than twelve feet. These dimensions can be modified on one foot modules. The shutters are provided with a self-secured panel lock assembly at the overlapping joints on the inside between the shutter and windows normally on two foot spacing vertically. This can be horizontal, however, in other applications. The system includes the utilization of an angle frame at the base, and an overlapping receiver as a header. End caps may be of varying shapes but normally are typical L-shaped angles. An alternative system is direct mounted and omits the header and the footer, but must extend above and below the opening by a minimum of four inches for a twelve inch wide shutter panel, or two inches for a six inch wide shutter panel. The panel lock assembly and its spacing remains the same as the embodiment utilizing a header and a footer except that the screws are positioned at the top and the bottom of the opening being covered. The shutters are installed by raising the same upwardly and inwardly to the overhang on the upper header, lowering the same to the point where the lower portion overlap has a keyhole slot, aligning the same, and then manually threading the panel lock assembly in place and the bottom lock screw in place. Where the extrusions of the system are not employed, the threaded members engage a concrete anchor secured in the wall of the structure.

Accordingly, it is a principal object of the present invention to provide a shutter, secured in a given system, and method for erecting the same which will pass the most stringent impact and static loads, and yet be inexpensive and easy to install by the home owner without any special tools.

Yet another object of the present invention is to provide a shutter, system, and method which will accommodate a wide variety of window openings, whether fixed, sliding, vertically movable, or otherwise installed.

Still another object of the present invention looks to a structure which has the flexibility from a standpoint of the installation to accommodate a wide variety of contractor and builder requirements.

BRIEF DESCRIPTION OF THE ILLUSTRATIVE DRAWINGS

The subject invention will be better understood taken in conjunction with the accompanying illustrative drawings, in which.

DESCRIPTION OF A PREFERRED EMBODIMENT

Figure 1:
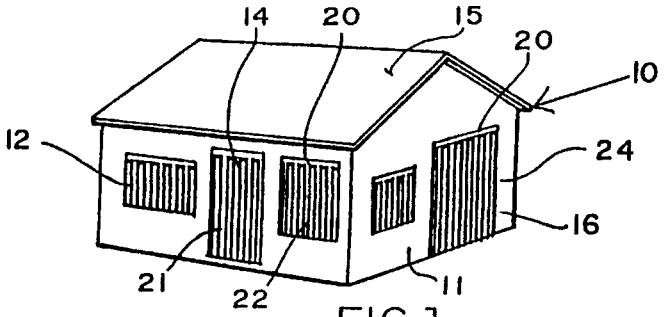
FIG. 1 is a perspective of a house showing a typical illustration of the subject shutter system and method employing the header, footer, and end caps of the system.

A typical installation of the subject shutter systems in several applications is shown in FIG. 1. There it will be seen that the house 10 has a plurality of walls 11, and windows 12. A door 14 is centrally disposed in the front wall of the building 10, and a sliding door 16 at a sidewall portion of the building 10.

Figure 7:
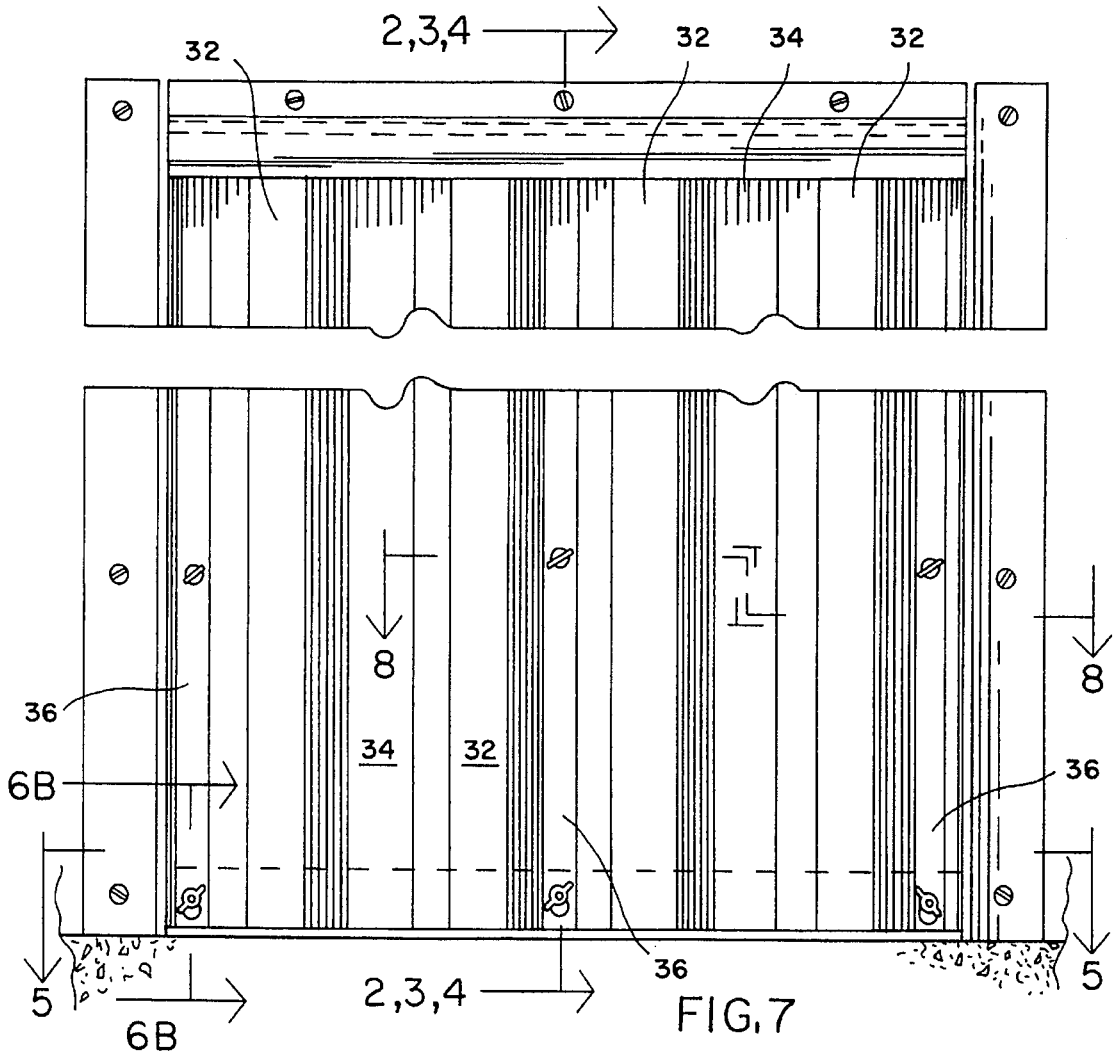
FIG. 7 is a plan view of a typical panel system.

The shutter system 20 as installed, in broad outline, will be best illustrated by reference to FIG. 7. There it will be seen that a plurality of shutter panels 30 have been joined together in a typical slide door 16 type installation. The sliding door shutter system 24 is noted in FIG. 1 where it will also be noted that there is a door shutter system 21 and a window shutter system 22.

Figure 8:
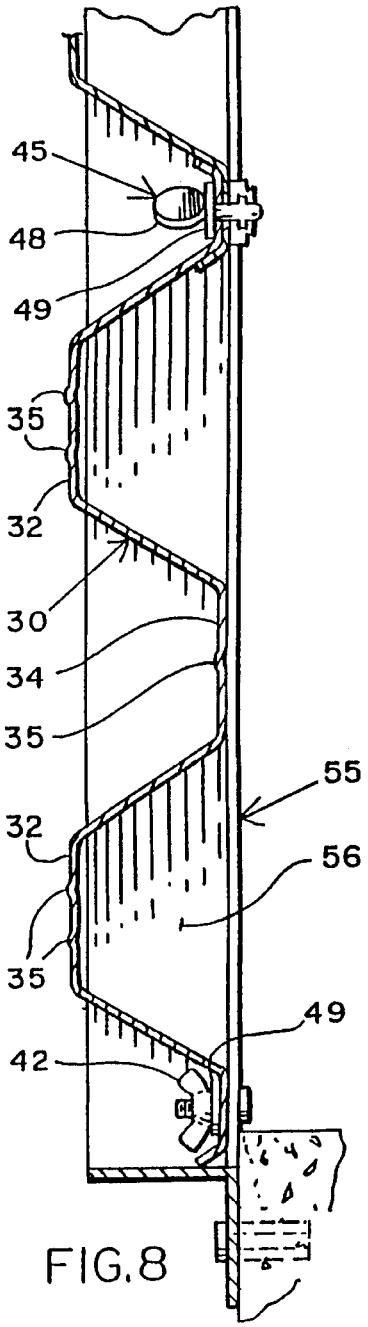
FIG. 8 is a transverse sectional view of a typical panel.

Turning now to FIG. 8 it will be seen that the illustrative shutter panel 30 includes a plurality of isosceles trapezoidal corrugations 31, including a ridge 32, and a groove portion 34. Ribs 35 are provided, as shown here, two on the ridge 32 and one centrally disposed on the bottom of the groove 34.

Figure 9:
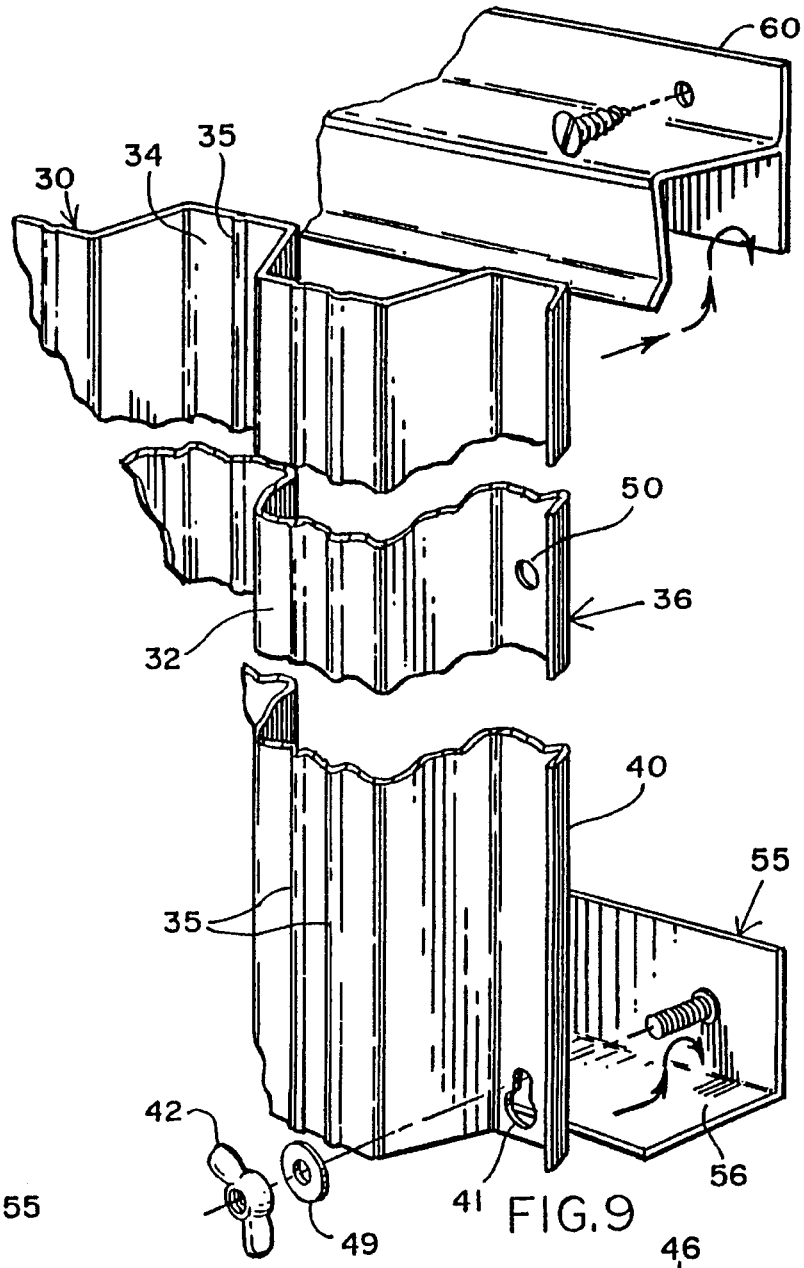
FIG. 9 is an exploded perspective partially broken view of the shutter system illustrative of the present invention.
Figure 10:
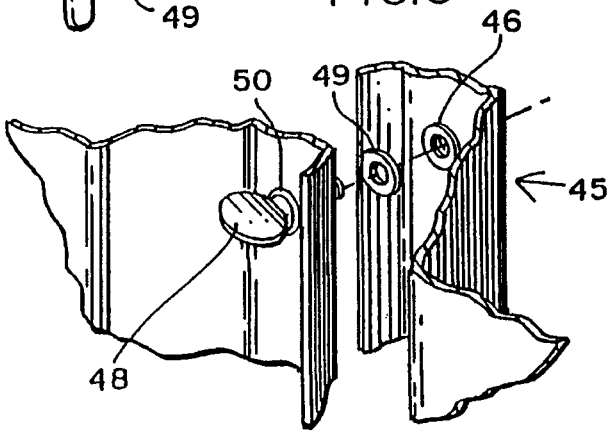
FIG. 10 is an enlarged perspective broken view concentrating on the lap joint and jack screw attachment portion of the system.

Turning now to FIGS. 9 and 10, there it will be seen that the lateral lip 36 has a lip bottom 38 and a lip edge lock 40. A keyhole opening 41 is provided in the lip bottom 38 at the lower extremity of the panel 30. The upper portion of the panel 30 mounts in a header 60 which may take various configurations as will be shown in the description of FIGS. 2, 3 and 4.

Turning now to FIG. 10 it will be seen that the panel lock assembly 45 includes a jack nut 46 which is secured to the lip channel 38 of the lip 36. A thumb screw 48 penetrates the lip bottom 38, passes through jack nut washer 49, and is threadedly engaged in the jack nut 46 by merely rotating with the thumb and forefinger.

Figure 2:
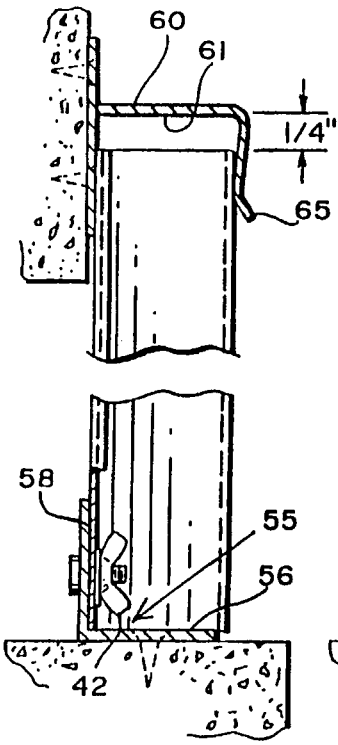
FIG. 2 is a transverse sectional view of a typical installation directly wall mounted taken along section 2—2 of FIG. 7.
Figure 3:
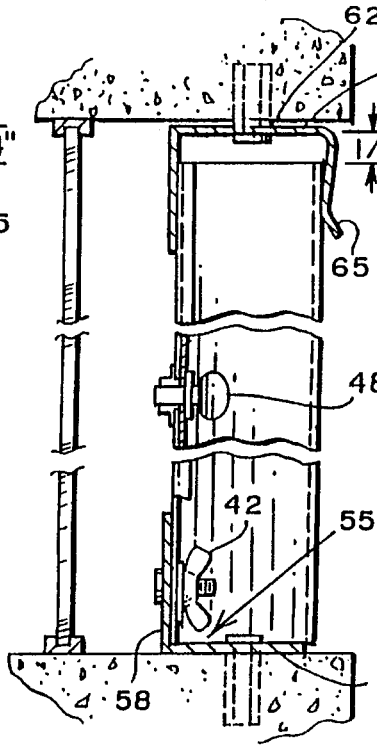
FIG. 3 is a transverse sectional view of a typical system ceiling mounted taken along section 3—3 of FIG. 7.
Figure 4:
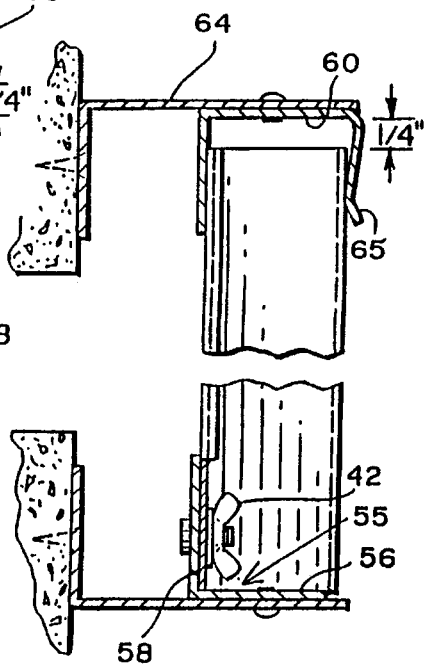
FIG. 4 is a transverse sectional view showing the same in a typical build-out or extended condition taken along 4—4 of FIG. 7.
Figure 5:
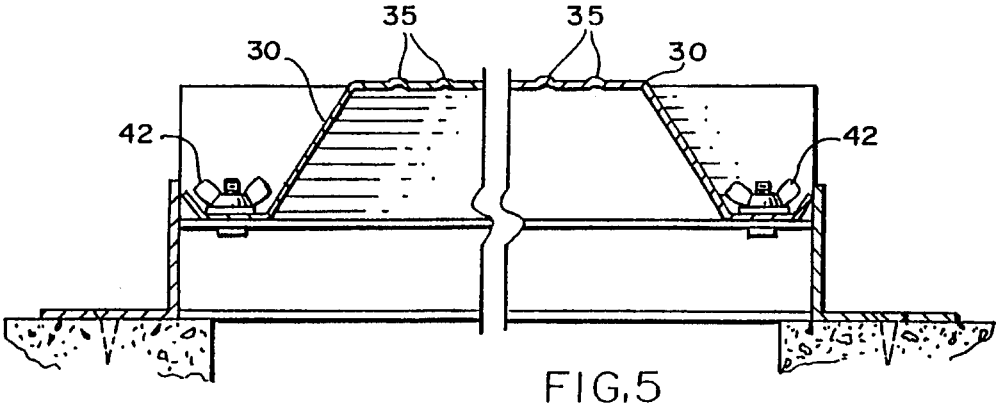
FIG. 5 is an end cap build-out condition taken at 5—5 of FIG. 7.

Various foot constructions 56 and header construction 60 are shown in FIGS. 2, 3, and 4. In the construction of FIG. 2, the foot 55 has a bottom 56 which is secured to a concrete or masonry or other type of sill at the lower portion of the bottom 56 of the foot 55. The shutter face 58 is engaged by the wing nut 42. In the system of FIG. 2 the header 60 includes a wall mount portion 61 and the header mount 62. In the embodiment shown in FIG. 3 which is spaced away from the window but interiorly of the sill, the header 60 is mounted by a typical masonry engaging support. In each instance, the header 60 has a grip portion 65 to engage the panel 30 upper portion. Finally, the extended mount 64 is shown in FIG. 4 where the entire shutter assembly system 20 is extended from the wall of the building structure.

Figure 6A:
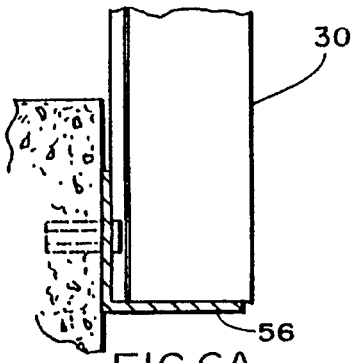
FIG. 6A is a further removable sill application and sill in broken form.
Figure 6B:
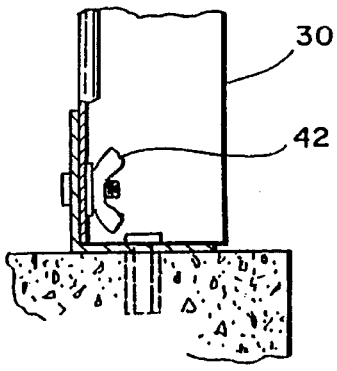
FIG. 6B shows a floor mount.

FIGS. 6A and 6B show illustrative floor mounts, FIG. 6A flush to the front portion of the floor, and FIG. 6B flush with the upper portion of the floor system. An illustrative embodiment of the present invention the panel 30 of FIG. 8 is nominally twelve inches from suspension point to suspension point. There is an overhang on either side to provide a lip engaging portion for the adjacent panel 30. Normally the height of the two corrugations 31 is two inches, the groove 34 is two inches, and the spacing of the top portion are 4.5 inches. A 0.063 thick aluminum 5052-H32 alloy is employed.

To further impart strength to the system 20, a pair of spaced longitudinal ribs 35 are provided on the upper portion of the corrugation 31, with a single longitudinal rib 35 on the lower groove portion 34. The header 60 is provided with spacing of 2.15 inches at the narrowest portion to snugly receive each of the panels 30 as it is slipped upwardly into the header 60, and then lowered onto the footer.

Each of the panels is provided with one or more jack nuts 46 which has its female portion securely mounted to the lip 36 of the underlying lip bottom 30 on the panel 30, and in spaced relationship longitudinally along the joint. A thumb screw 48 is provided to secure from the overlapping adjacent panel through the underlying fixed jack nut 46.

At the other end of the joint, a keyhole slot 41 is provided in both sides so that a bolt secured from the rear portion of the L-shaped receiver can be mounted as a hanger. To this end, a keyhole slot is provided in which the dimensions of the slot are at least 25% to 50% larger than the diameter of the bolt. The round portion of the keyhole slot is significantly larger. With the hole that the wing nut passes through to the fixed nut on the underlying lower shoe of the panel, a 25% to 50% oversized hole is also desirably added.

Figure 11:
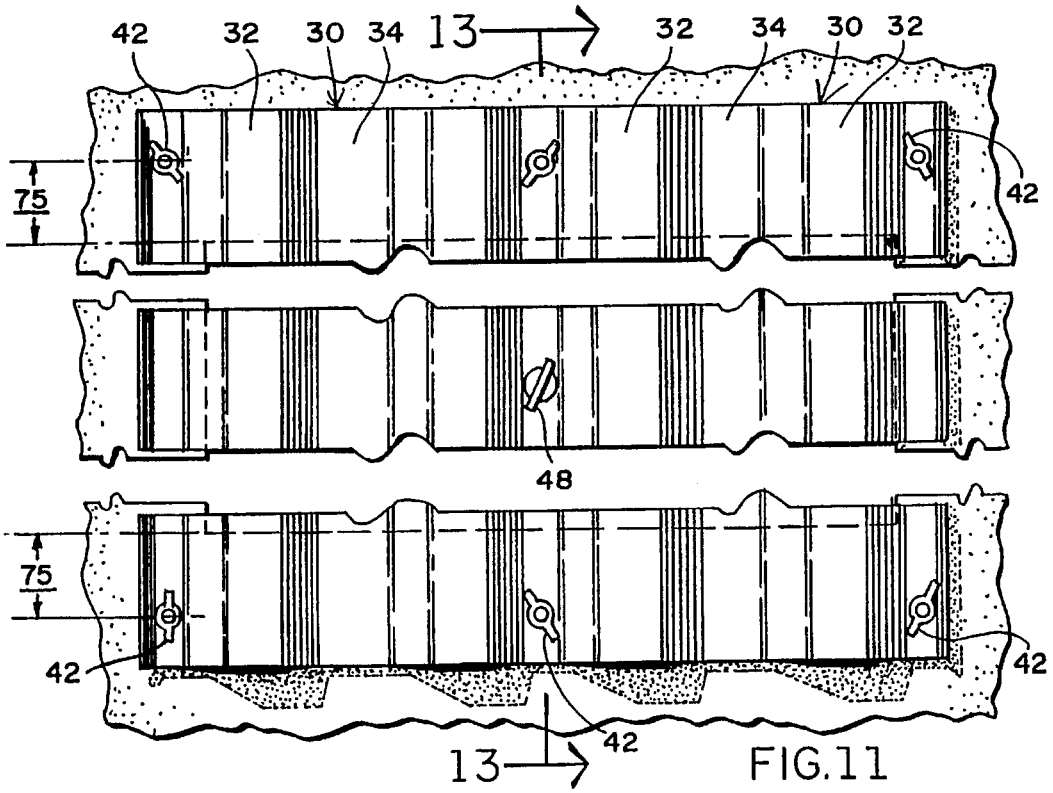
FIG. 11 is a view comparable to FIG. 7, but illustrating the alternative direct mount embodiment which omits headers, footers, and is secured directly at both the top and the bottom by an overlap.
Figure 12:
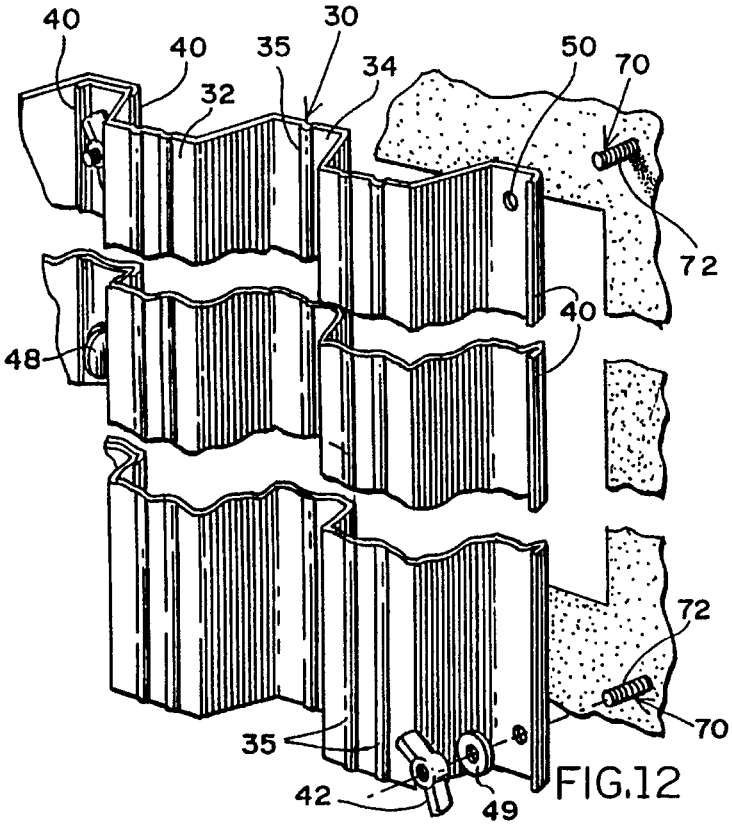
FIG. 12 is a view similar to FIG. 9, but illustrating the direct mount with the omission of the footer and the header.
Figure 13:
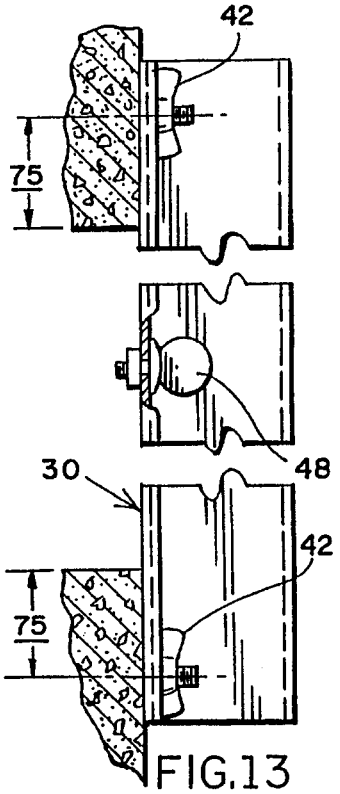
FIG. 13 is a vertical section taken along 13—13 of FIG. 11.

In accordance with another aspect of the present invention, the shutter panels 30 may be directly mounted to the wall 11. This is illustrated in FIGS. 11 and 12. There it will be seen that the header 60 and the footer 55 are omitted from the construction. In order to directly mount, however, the center spacing of the top and bottom wing nuts 42 through the keyhole mounting portion 41 is important. If the mounts are on twelve inch centers, the shutter panel must overlie the opening at the top as well as at the bottom by at least four inches. On the other hand, if the shutter panel is only six inches wide, the subject overlap is two inches passed the opening both top and bottom. The same dimension applies to the lateral edges.

When the direct mount is used the screw 70 is left in the wall with the screw head extending outwardly. The screw head imay be of an overall diameter or diagonal dimension small enough to fit through the large hole portion of the keyhole 41, whereas the shank 71 of the screw 70 with threads 72 is proportioned to snugly fit the slot portion of the keyhole. Important to the invention, and to the direct wall mount, is the utilization of the panel mounting assembly 45 on the lateral lips 36 of the shutter panel 30 for securement of the adjacent shutters each to the other in spaced relationship running from the top to the bottom of the overlapped lateral legs 36. That remains the same as with the preferred embodiment set forth above. Similarly the securement over the walls of the opening must be on the same spacing. This permits an adequate sealing of the area in the opening, whether a window, sliding glass door, or otherwise exposed to hurricane force winds only over the top and the bottom of the corrugated shutter. The spacing 75 from the opening to the screw 70 is sufficient to inhibit the development of a compression zone behind the monolithic shutter system. The spacing 75 should be four inches for a twelve inch panel and two inches for a six inch panel.

When the header 60 and footer 65 are not employed, the shutters are ideally secured by anchors 70 in concrete which are one-quarter inch tapcons, one and three-quarter inch imbedded or equivalent. For removable applications, it is best to use Rawl Caulk-In anchors which are one-quarter inch by seven-eighths inch imbedded or equivalent.

All bolts, nuts, and washers are ideally stainless steel or aluminum alloy 2024-T4 or 7075-T6 or plated steel. The ideal ceiling header 60 has a foot portion 0.062 inches thick, with the bridge and overlap 0.100 inches. The same is proportioned so that the foot extends at least one-half inch beyond the shadow of the overlapping securing top member to permit easy access for drilling to secure the same to a wall.

More specifically, the panels 30 are ideally 0.063 aluminum alloy 5052-832 or ASTMB209-92A. They have a nominal width of twelve inches, with a total width of 13.5 inches, forming 2.00 inch deep ribs. The minimum separation to existing glass which i to be protected is 2.55 inches. The maximum clearance between the top of the panel and the inside of the header is one-quarter inches. As to special requirements, a one-quarter inch by one-half inch thumb screw 48 with washer 49 goes into the jack nut 46. They are spaced at twenty-four inch centers longitudinally along the joint, and are used to join all panels at the lap joints. Steel can also be used for the subject panels. The thickness should exceed 0.035 inches and sustain an ultimate load of at least 1064; a yield load of at least 862; an ultimate strength in psi of at least 55,150, and a yield stres psi of at least 44,675. The elongation should be at least 27.5% or less, the "E" factor 30×10 to the sixth power, Webster hardness 17, and Rockwell hardness 67. The aforesaid should conform to ASTM A525 for tolerances, and ASTM A446-93. The surface treatment is hot dip zinc coated with mill edge to a thickness of at least 0.035 inches.

Installation Proceeds as Follows

A) Wall Mount (Direct Mount)

The panels are secured inside a top track (wall mount header) 60 at the head, which is anchored to the wall, and fastened to the 2"×2"×0.125" (floor angle) continuous studded aluminum angle at the sill, using ¼"-20 studs with washer wing nut spaced at 12" o.c.

B) Ceiling/Inside Mount

The panels are secured inside a top track (ceiling mount header) at the head, which is anchored to the inside of opening, and fastened to the 2"×2"×0.125" (floor angle) continuous studded aluminum angle at the sill, using ¼"-20 studs with washer wing nut spaced at 12" o.c.

C) Built-Out Condition

Same as above, except (as shown in FIG. 4) that the (ceiling mount header 60) at the top and the 2"×2"×0.125" continuous studded aluminum angle (floor angle) at the sill, are each secured with #10-16×¾" #2 point self-drilling hex washer head screws spaced at 12" o.c. to a 2"×4"×⅛" aluminum angle (built-out support) used to provide the build out and which is anchored to the wall.

D) Any Combination of the Above

Anchorage of the aluminum angles shall be to concrete, masonry and/or wood framing and shall consist of only the anchors. Permanent set fastener components, embedded anchor bolts, threaded cones or metal shields, not in use, must be protected against corrosion, contamination and damage at all time.

The method of the present invention is directed to the installation of overlapping shutters in which the same are secured to the building structure by keyhole slots at the lower portion, and a keyhole slot at the upper portion in the event a header is not employed. The installer positions the units over the keyhole slots and into the upper portion first, and then thereafter takes the thumbscrews and manually secures them into the jack nuts which are securely fixed to the underneath portion of the overlapped portion of the adjacent panel. The method of mounting the direct mount implies that the installer will start at one lateral edge or the other of the opening. Each panel is hung over two screws 70 at the top, and then positioned over the two screws at the bottom. After they are all hung, or sequentially while hanging, the screws are tightened, the overlapping troughs at the lateral edges of the panels are the subject of securement by the panel lock assembly 45 and jack nuts 46 or other fasteners, and then finally the bottom and the lateral edges are secured in place. To remove the panels, the very reverse is undertaken where either all screws can be loosened preliminarily, and the shutter panels blank removed sequentially, or one or more panels at a time can have the screws and jack screws removed, and then be sequentially moved for storage.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A shutter system for enclosing an opening in a wall of a structure comprising, in combination:

a plurality of shutter panels, each of said panels having lateral edges that terminate in a pair of parallel lips, each such lip having a lip bottom and an edge lock angled upwardly from the lip bottom, such that each panel can be overlapped with a like panel along their lips, each of said panels having a vertically spaced releasably securable means along the lip bottoms for securing said panel to a like panel that has been placed adjacent thereto and overlapped along the lip, each of said panels having a laterally spaced releasably securable means top and bottom for securing said panel to a wall opening, each of said panels having a laterally spaced releasably securable means top and bottom for securing said panel to a wall opening, each panel being characterized by an isosceles trapezoidal cross-sectioned configuration comprised of a pair of parallel ribs flanking a single groove, whereby when said panels are overlapped on their lips to form an interlocked panel system they form a shutter system for enclosing an opening in a wall of a structure.

2. The shutter system of claim 1, in which a six inch panel is being shuttered from the bottom and top to the laterally spaced releasably securable means.

3. The shutter system of claim 1, in which a twelve inch panel is being shuttered from the bottom and the top to the laterally spaced releasably securable means.

4. The panel of claims 1, 2, or 3 in which the aluminum forming the same is the equivalent of 0.063 aluminum alloy 5052-832 or ASTMB 209-92A.

5. In any of claims 1, 2, or 3 above, in which the material is hot-dip zinc-coated mill edge steel ASTM A525 thickness and tolerance plus only galvanized steel, structural quality, ASTM A446-93 thickness 0.035 inches, the equivalent.

6. The method of assembling a shutter system for enclosing an opening in a wall of a structure in which a plurality of shutter panels are employed, in which each of said panels has an isosceles cross-section configuration including a pair of parallel ribs flanking a single groove and lateral edges with lips, and each of the shutter panels having a keyhole mounting means, the steps comprising:

fixing securing means in said wall of a structure surrounding an opening in top and bottom alignment, positioning panels adjacent each other to define a shutter system, securing the adjacent panels to the securing means top and bottom, positioning uniform spaced panel lock assemblies along the lips of adjacent overlapped shutter panels; and engaging the panel lock assemblies and said keyhole mounting means to secure the panels to said wall of a structure and to each other, thereby enclosing the opening in the wall of the structure.

* * * * *